US006948774B2

(12) United States Patent
Maier et al.

(10) Patent No.: US 6,948,774 B2
(45) Date of Patent: Sep. 27, 2005

(54) ARMREST

(75) Inventors: Klaus Maier, Dachsberg (DE); Michael Klaesener, Waldshut (DE); Thomas Stenzel, Waldshut (DE)

(73) Assignee: Sedus Stoll AG, Waldshut-Tiengen (DE)

( * ) Notice: Subject to any disclaimer, the term of this patent is extended or adjusted under 35 U.S.C. 154(b) by 0 days.

(21) Appl. No.: 10/644,810

(22) Filed: Aug. 21, 2003

(65) Prior Publication Data

US 2004/0066080 A1 Apr. 8, 2004

(30) Foreign Application Priority Data

Oct. 4, 2002 (EP) ..... 02022433

(51) Int. Cl.[7] ..... A47C 7/54

(52) U.S. Cl. ..... 297/411.31; 297/411.36; 297/411.37; 297/411.35

(58) Field of Search ..... 297/411.35, 411.36, 297/411.37, 411.31

(56) References Cited

U.S. PATENT DOCUMENTS

| | | | | | |
|---|---|---|---|---|---|
| 5,590,934 | A | * | 1/1997 | Gibbs | 297/411.38 |
| 5,641,203 | A | * | 6/1997 | Van De Riet et al. | 297/411.37 |
| 5,749,628 | A | * | 5/1998 | Synder et al. | 297/411.36 |
| 5,752,683 | A | | 5/1998 | Novis et al. | |
| 5,927,811 | A | * | 7/1999 | Tseng | 297/353 |
| 5,931,536 | A | * | 8/1999 | Wu | 297/411.35 |
| 6,053,578 | A | * | 4/2000 | van Hekken et al. | 297/411.35 |
| 6,059,366 | A | * | 5/2000 | Hu | 297/411.35 |
| 6,076,891 | A | | 6/2000 | Bernhardt | |
| 6,076,892 | A | | 6/2000 | van Hekken et al. | |
| 6,106,070 | A | * | 8/2000 | Ritt et al. | 297/411.35 |
| 6,502,904 | B1 | * | 1/2003 | Hansen | 297/411.35 |
| 6,619,746 | B2 | * | 9/2003 | Roslund et al. | 297/411.36 |
| 2003/0030317 | A1 | * | 2/2003 | Chen | 297/411.35 |

FOREIGN PATENT DOCUMENTS

| | | |
|---|---|---|
| EP | 0 809 957 | 12/1997 |

* cited by examiner

*Primary Examiner*—Peter M. Cuomo
*Assistant Examiner*—Sarah C. Burnham
(74) *Attorney, Agent, or Firm*—Oblon, Spivak, McClelland, Maier & Neustadt, P.C.

(57) ABSTRACT

A chair, such as a swivel chair for the office, has an armrest that is made up of an armrest carrier, which includes a carrier and a sleeve sliding thereon and attached to the seat at the bottom by a seat flange which can be displaced transversely to the seat direction, and of an arm support, which can be displaced longitudinally via a guide and can be rotated via a rotary part mounted in a rotary bearing. The guide is arranged parallel, but eccentrically in relation, to the axis of symmetry of the arm support. Since the rotatability of the arm support is at least 1800, it is possible to set different clear distances between the two arm supports of the chair.

11 Claims, 3 Drawing Sheets

ARMREST

TECHNICAL FIELD

The invention relates to the field of seating furniture, in particular to a three-dimensionally adjustable armrest for an office chair.

PRIOR ART

Different technical solutions for chairs which allow the user to change the position of the arm support are known.

For example, EP 0 809 957 A3 discloses a chair in the case of which the arm support can be adjusted three-dimensionally, that is to say in respect of height, in a horizontal plane and in respect of rotation. The arm support here is fastened on an attachment plate, fitted at the top end of the carrier, and can be rotated about a pin and displaced longitudinally via a sliding body. The axis of rotation of the arm support is located centrally in the arm support and eccentrically in relation to the centre axis of the carrier. This design only allows the clear distance between the arm supports of the chair to be changed to a limited extent. In design terms, the known solution involves high outlay to produce and install and is not particularly stable.

U.S. Pat. No. 6,076,891 discloses the armrest of a chair in the case of which the arm support is mounted in a pivotable manner on a horizontal arm which, for its part, is mounted in a pivotable manner on a vertical, height-adjustable carrier. Although this design provides considerable scope for movement for the arm support in a horizontal plane, it is of complex design, is not very stable and also is not aesthetically acceptable to the user.

U.S. Pat. No. 5,752,683 discloses an armrest which specifically avoids the occurrence of carpal tunnel syndrome in individuals who spend long periods of time working with equipment such as typewriters, personal computers and the like. Provided for this purpose is a longitudinally extending, high-outlay arm support which can be displaced over a considerable distance in the forward and rearward directions and, at the front, has a special, swing-up supporting means for the ball of the thumb, and which is mounted in a pivotable manner on the vertical carrier. The known armrest is of extremely complex design and is not suitable for mass production.

U.S. Pat. No. 6,076,892 discloses an armrest which provides for a large number of movement possibilities for the arm support: heightwise, forwards and rearwards, laterally and in rotation. This known armrest also involves extremely high outlay and is far too expensive for mass production.

There is thus a real need for an armrest which, while being as adaptable as possible to the user's requirements, is nevertheless straightforward to produce and install and is thus suitable for use in reasonably priced mass-produced furniture. In particular, it should be possible for the clear distance between the arm supports to be easily varied, because the clear distance between the arm supports of an office chair is a critical, and in some cases country-specific, magnitude. Thus, for example, in accordance with EU standards, the maximum clear distance is 460–510 mm, while, in the Netherlands, the clear distance should be a minimum of 390–510 mm.

However, both in respect of production outlay and from the sales standpoint, the way in which these conflicting requirements should be tackled is problematic.

DESCRIPTION OF THE INVENTION

The object of the invention is thus to develop an armrest which makes it possible for the clear distance between the two arm supports to be adjusted in a straightforward manner without particular production or installation outlay being necessary for this purpose.

This object is achieved by the features of claim 1 and of the subclaims.

The invention is based on the idea of providing the arm support with a guide which slides on guide noses—blocks—which are fastened on a rotary part mounted in a rotatable manner on the backrest carrier, and in the process of arranging the guide eccentrically in relation to the point of rotation of the rotary part. This allows for a combination of a longitudinal movement and rotary movement of the arm support, in the case of which, on account of the eccentricity of the rotation, it is possible to set a variety of clear distances between the two arm supports.

BRIEF DESCRIPTION OF THE DRAWINGS

The invention is explained in more detail hereinbelow with reference to an exemplary embodiment illustrated in drawings, in which.

METHODS OF IMPLEMENTING THE INVENTION

Figure 1:
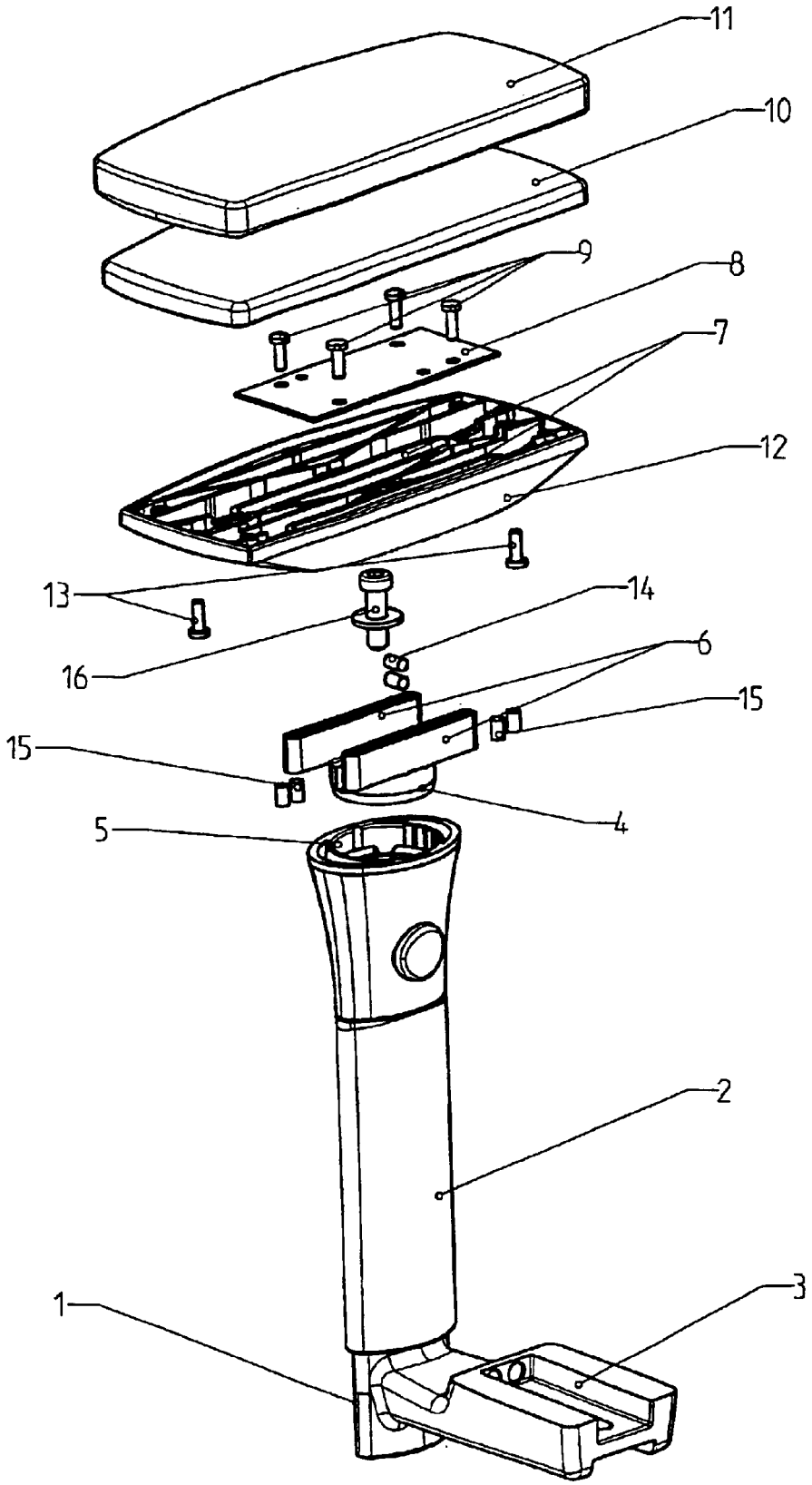
FIG. 1 shows an armrest according to the invention in an exploded illustration.

FIG. 1 illustrates a carrier 1 on which a sleeve 2 is arranged for sliding action. The carrier 1 is connected to a seat flange 3, which is fastened on the chair (not shown). The seat flange 3 has two slots and can be displaced transversely to the seat direction. The seat direction here is the direction from the backrest to the front edge of the chair. The height of the armrest can be adjusted by means of the sleeve 2 sliding on the carrier 1. These technical measures are all known per se and will thus not be explained in any more detail.

The rotary bearing 5 is provided at the top end of the sleeve 2. The rotary part 4 is mounted in a rotatable manner in said bearing 5. The rotary part 4 has the guide noses 6, which are connected integrally to the rotary part 4. The rotary part 4 is screwed in the rotary bearing 5 by the central screw 16.

Elastic latching protrusions 15 are accommodated in recesses of the rotary part 4 and correspond with notches on the inner circumference of the rotary bearing 5. In the installed state, the rotary part 4 is thus fixed in position, during rotation, wherever the latching protrusions 15 end up in a notch.

In the installed state, the guide noses 6 engage from beneath in the two guides 7 in the guide housing 12. A retaining plate 8 is provided on the other side of the guides 7. This retaining plate is fastened on the guide noses 6 by means of the retaining screws 9. The housing screws 13 are used to fasten the guide housing 12 on the carrying panel 10, which bears the foamed-on pads 11.

In the installed state, the underside of the guide housing 12 slides between the two guide noses 6 on the surface of the rotary part 4. In this case, the arm support is displaced in the longitudinal or seat direction. In order for it also to be possible for this displacement to take place in fixed latching positions, the horizontal latching protrusions 14 are provided in a rotary part 4, and notches are provided on the underside of the guide housing 12. Fixed latching positions are thus produced whenever the expansible latching protrusions 14 end up in a notch on the underside of the guide housing 12.

Figure 2:
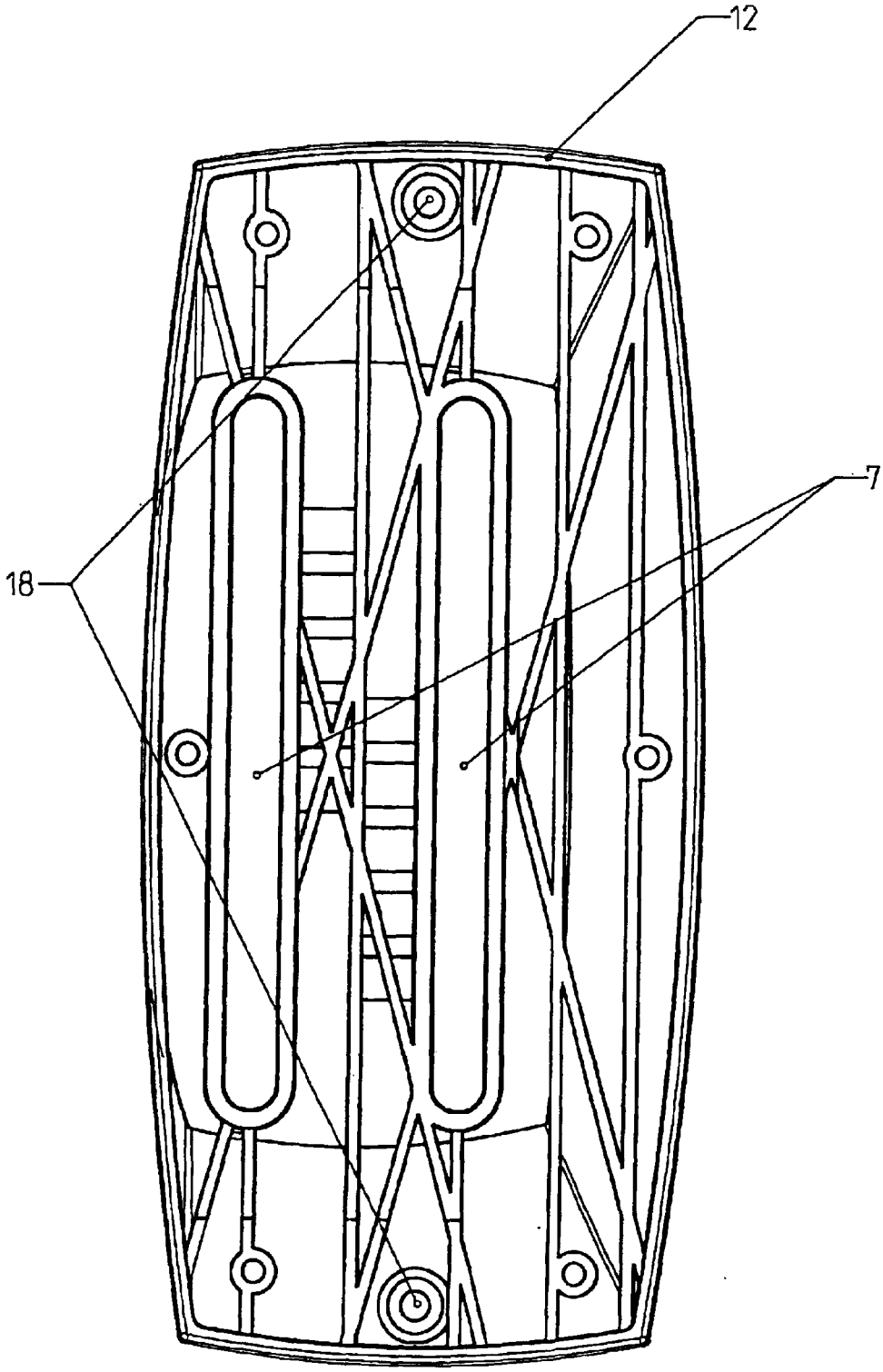
FIG. 2 shows a plan view of the guide housing.

The details of the guide housing 12 are illustrated again more specifically in FIG. 2. The two eccentrically located guides 7 in particular can better be seen. It is also possible to see the bores 18, through which the housing screws 13 are screwed into the carrying panel 10. The rotary bodies and crosspieces (not designated) form a skeleton for stabilizing the guide housing 12. This comprises a plastic injection moulding, preferably made of PA/polyamide.

Figure 3:
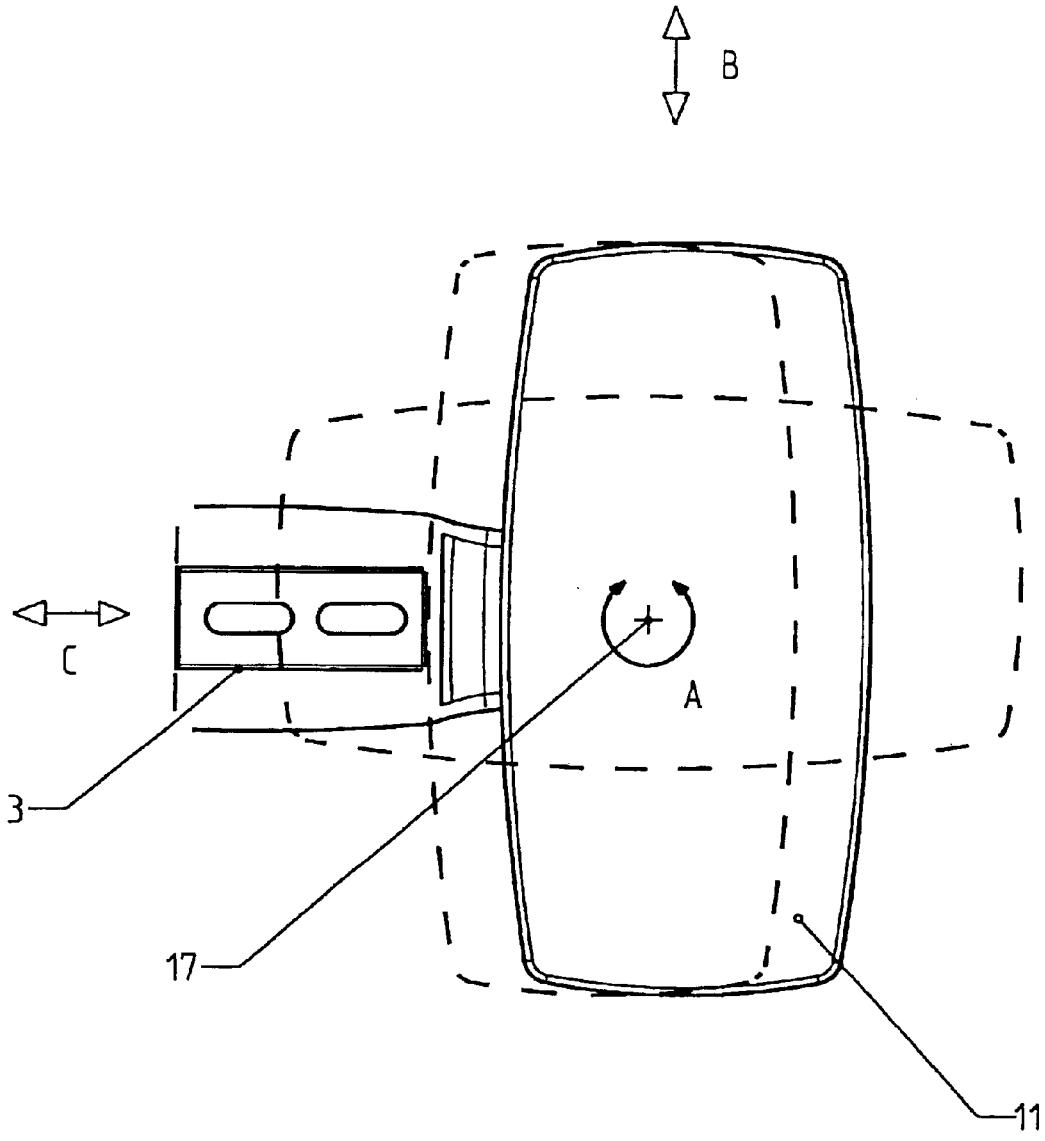
FIG. 3 shows a plan view of an armrest according to the invention with an illustration of the various movement possibilities for the arm support.

FIG. 3 shows the pad 11 from above in various positions. As can be seen, the axis of rotation 17, that is the centre axis of the rotary part 4, is located eccentrically in relation to the axis of symmetry of the pad 11 which runs in the seat direction.

The pad 11 can be displaced longitudinally in direction B. This movement is made possible by the sliding movement in the guides 7. It may also be rotated, however, about the axis 17 in accordance with the double arrow A. This rotation is made possible by the rotary part 4. Finally, however, it is also possible for the carrier 1 to be moved in direction C by means of the seat flange 3.

With all these movement possibilities, the result is not just a large number of adjustments for the arm support with the pad 11; the eccentricity of the guides 7 also makes possible a large number of clear distances between the two arm supports of a chair.

The armrest according to the invention preferably consists of the following material:

The carrier 1 and seat flange 3 consist of injection-moulded plastic, the sleeve 2, rotary part 4 and housing 12 consist of injection-moulded plastic, preferably PA, the retaining plate 8 is a punched part made of sheet metal, and the carrying panel 10 with pad 11 is PA with a PUR covering. The latching protrusions 14 and 15 consist of steel with resilient elements made of PUR.

LIST OF DESIGNATIONS

1 Carrier
2 Sleeve
3 Seat flange
4 Rotary part
5 Rotary bearing
6 Guide noses
7 Guide
8 Retaining plate
9 Retaining screws
10 Carrying panel
11 Pad
12 Guide housing
13 Housing screws
14 Expansible latching protrusions
15 Rotary latching protrusions
16 Fastening screw for rotary part
17 Axis of rotation
18 Bores

What is claimed is:

1. Three-dimensionally adjustable armrest, comprising:

an armrest carrier configured to be adjusted in height; and an arm support configured to be adjusted longitudinally in a horizontal plane and to be rotated through at least 90° about an axis, wherein the axis is eccentric in relation to an axis of symmetry of the arm support which runs in a seat direction, and the longitudinal adjustability and the eccentric rotatability of the arm support are achieved in that a carrying panel of the arm support is connected to a longitudinally running guide in which guide noses of a rotary part run, the rotary part mounted in a rotatable manner in a rotary bearing at a top end of the armrest carrier, and the guide-arranged parallel and eccentrically in relation to the axis of symmetry of the arm support.

2. Armrest according to claim 1, wherein a vertical distance between a point of eccentric rotation and the axis of symmetry of the arm support is between 5 and 15 mm.

3. Armrest according to claim 1, wherein the guide is arranged in a housing which is screwed to an underside of a carrying panel by screws, and connection to the rotary part is achieved in that a retaining plate is provided above the guide, the retaining plate screwed to the guide noses of the rotary part via retaining screws.

4. Armrest according to claim 1, wherein the armrest carrier comprises a carrier, which is connected to a seat via a seat flange configured to be adjusted transversely to the seat direction, and a sleeve, which slides on the carrier and in the top end of which is provided the rotary bearing with the rotary part, and in that vertical rotary latching protrusions are provided on a circumference of the rotary part and horizontal expansible latching protrusions are provided between an underside of the housing and the rotary part, such that the arm support is configured to be fixed in a number of positions both in a rotary direction and along the seat direction.

5. Armrest according to claim 1, wherein, with the arm support rotated through 90° in relation to the seat direction, a distance between two arm supports configured to vary by up to 2 cm on each side.

6. Armrest according to claim 1, wherein the arm support is configured to be rotated through at least 180°.

7. Armrest according to claim 3 or 5, wherein the arm support is configured to be fixed in rotary positions which differ from one another by 15°.

8. Armrest according to claim 5, wherein the distance between the two arm supports of the chair is configured to be from 30 cm to 55 cm.

9. Armrest according to claim 1, wherein a vertical distance between a point of eccentric rotation and the axis of symmetry of the arm support is 10 mm.

10. Armrest according to claim 1, wherein the guide is arranged in a housing which is fastened to an underside of a carrying panel, and connection to the rotary part is achieved in that a retaining plate is provided above the guide, the retaining plate fastened to the guide noses of the rotary part.

11. A chair, comprising:

an adjustable armrest comprising:

a carrier adjustable in height; and a support adjustable longitudinally in a horizontal plane and rotatable through at least 90° about a first axis, wherein the first axis is disposed eccentrically relative to an axis of symmetry of the support extending in a seat direction, the support is connected to a longitudinally extending guide in which a protrusion of a rotary component is configured to move, the rotary component mounted in a rotary bearing disposed in the carrier, to thereby permit longitudinal adjustability and eccentric rotatability of the support, and the guide is disposed parallel and eccentrically relative to the axis of symmetry of the support.

* * * * *